United States Patent [19]

Pringle

[11] Patent Number: 4,512,411

[45] Date of Patent: Apr. 23, 1985

[54] FLUID ACTUATED ENERGY CHARGED WELL SERVICE LINE CUTTER

[75] Inventor: Ronald E. Pringle, Houston, Tex.

[73] Assignee: Camco Incorporated, Houston, Tex.

[21] Appl. No.: 601,896

[22] Filed: Apr. 19, 1984

[51] Int. Cl.[3] ..... E21B 29/04

[52] U.S. Cl. ..... 166/54.5; 166/55.3

[58] Field of Search ..... 166/54.5, 54.6, 55, 166/55.2, 55.3, 55.1, 298

[56] References Cited

U.S. PATENT DOCUMENTS

| | | | |
|---|---|---|---|
| 1,813,368 | 7/1931 | Toles | 166/55.3 |
| 3,073,388 | 1/1963 | Chenault | 166/54.5 |
| 3,193,013 | 7/1965 | Whiteside | 166/54.5 |
| 4,237,972 | 12/1980 | Lanmon | 166/54.5 |

*Primary Examiner*—Stephen J. Novosad
*Assistant Examiner*—Hoang C. Dang
*Attorney, Agent, or Firm*—Fulbright & Jaworski

[57] ABSTRACT

A well service line cutter for connection in a well conduit for cutting a line extending therethrough. A housing having a bore through which a service line may extend and the housing is adapted to be connected in a well conduit. An energy chamber for holding pressurized gas is releasably contained by a hydraulic valve mechanism which in turn is held closed by a hydraulic control line extending to the well surface. Release of the hydraulic pressure opens the valve allowing the compressed gas to actuate a piston which moves cutters into the bore for cutting any line in the bore. A biasing mechanism is connected to the piston for returning the piston and cutter to the retracted position and opening the bore after cutting the line. The energy chamber may be charged for a single operation or may be recharged by a line extending to the well surface.

18 Claims, 13 Drawing Figures

FLUID ACTUATED ENERGY CHARGED WELL SERVICE LINE CUTTER

BACKGROUND OF THE INVENTION

Various types of service tools on service lines are used in oil and/or gas wells to perform downhole operations. The service line extends through safety valves and may be performing operations thousands of feet below the well surface in the well conduit, such as a production or test string. However, with the service line extending through the well conduit, the safety valve cannot be shut in the event of an emergency, such as a well blowout. That is, it is necessary to remove the service wire or cut the service wire in order to allow the safety valve to operate or for other reasons.

The present apparatus is directed to providing a well service line cutter which may be installed in the well conduit and has a bore as large as the internal diameter of the well tubing conduit so as not to interfere with the well operation, but which can quickly cut the service wire in the event of an emergency, and which can thereafter return to its full open position after cutting the service wire so that the wireline tool string can be retrieved after the well emergency is overcome.

SUMMARY

The present invention is directed to a fluid actuated energy charged well service line cutter for connection in a well conduit for cutting a line extending therethrough. A cutter includes a housing which has a bore through which the line may extend and the housing includes connections for attaching the housing in a well conduit. The housing includes an energy chamber for holding energy with a valve means connected to the chamber for releasing energy from the chamber. A control passageway is connected to the valve means and extends to the well surface for actuating the valve means. Piston means are provided in the housing in communication with the energy chamber through the valve means whereby the piston is actuated when the valve means releases energy from the chamber. Cutter means in the housing is normally retracted out of the bore, but the cutter means is connected to and moved by the piston into the bore for cutting any line in the bore. Return means are provided connected to the piston and cutter for returning the piston and cutter to the retracted position.

Still a further object is wherein the energy chamber is a pressurized gas chamber. Preferably the gas chamber is an eccentrically shaped chamber for economically manufacturing while providing a thick wall for containing a pressurized control line.

Yet still a further object of the present invention is wherein the returning means for retracting the piston and cutter means is a biasing means such as a spring acting against the piston.

Still a further object of the present invention is wherein the valve means includes a valve closing the energy chamber with a control piston acting against the valve for holding the valve initially closed against the force of the pressurized gas. The control means includes hydraulic fluid initially acting against the control piston for holding the valve closed, but allowing the valve to open on a decrease in the hydraulic fluid pressure. Thus the cutter is actuated by a decrease in the hydraulic pressure which can be usually be accomplished even under emergency conditions.

Still a further object of the present invention is wherein the gas chamber includes a supply line to the well surface for charging and recharging the gas chamber.

Still a further object of the present invention is wherein the piston means is positioned below the chamber and the cutter means is positioned below the piston and the piston means includes a seal which restricts but allows the passage of fluid whereby cleaning fluid may be inserted into the chamber for cleaning and bypassing the piston and cleaning the parts of the cutter by flushing out well fluids.

Yet a further object of the present invention is wherein the cutter means includes first and second coacting cutters. Cam means are provided between the first and second cutters and the actuating piston means for moving the cutters inwardly and outwardly in response to movement of the actuating piston.

A further object is wherein the cam means include first ears on the first cutter and second ears on the second cutter with first and second tracks connected to the actuating piston for receiving the first and second ears, respectively, and the first and second tracks cross each other. The first ears and the first tracks are of a different depth than the depth of the second ears and the second tracks for reducing the possibility of the ears catching in the wrong track.

Yet a further object is the provision of a shock absorber in the cutting mechanism for overcoming the shock of the pressurized energy actuating the cutter.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
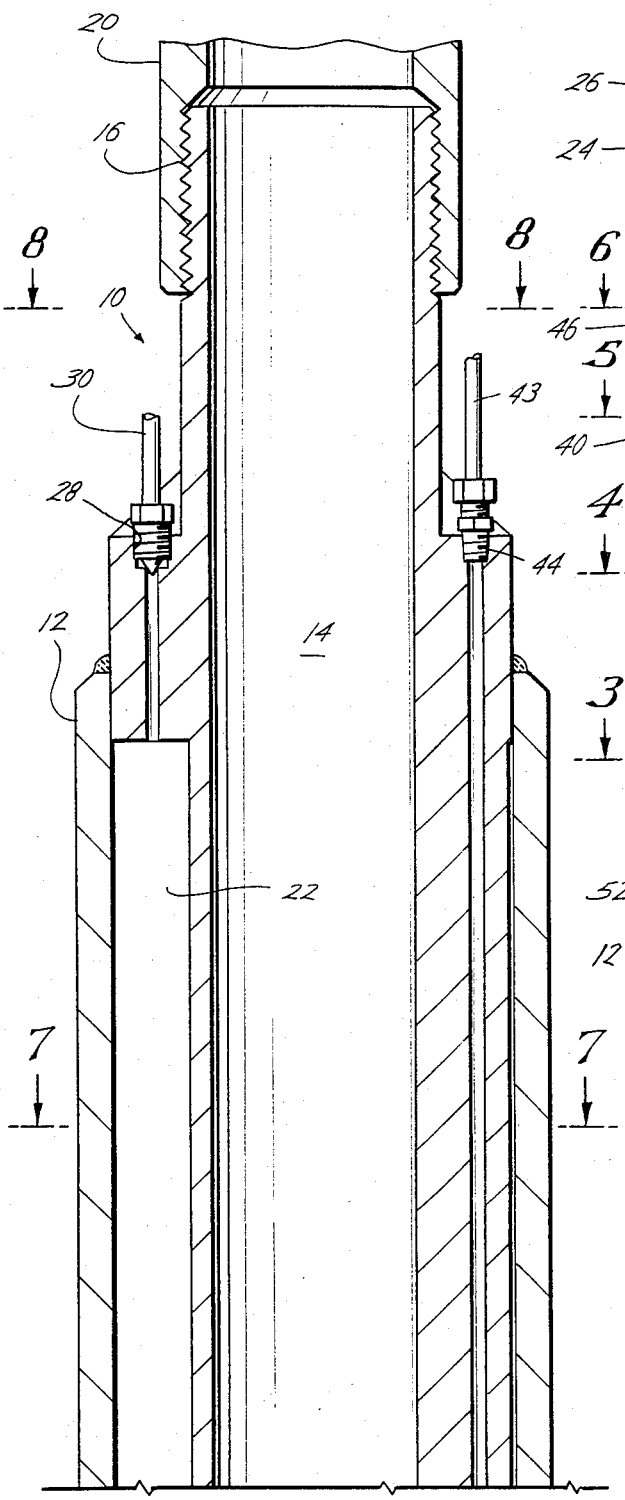
FIGS. 1A, 1B and 1C, are elevational views, in cross section, and continuations of each other of the apparatus of the present invention shown connected in a well conduit in the open position.
Figure 1B:
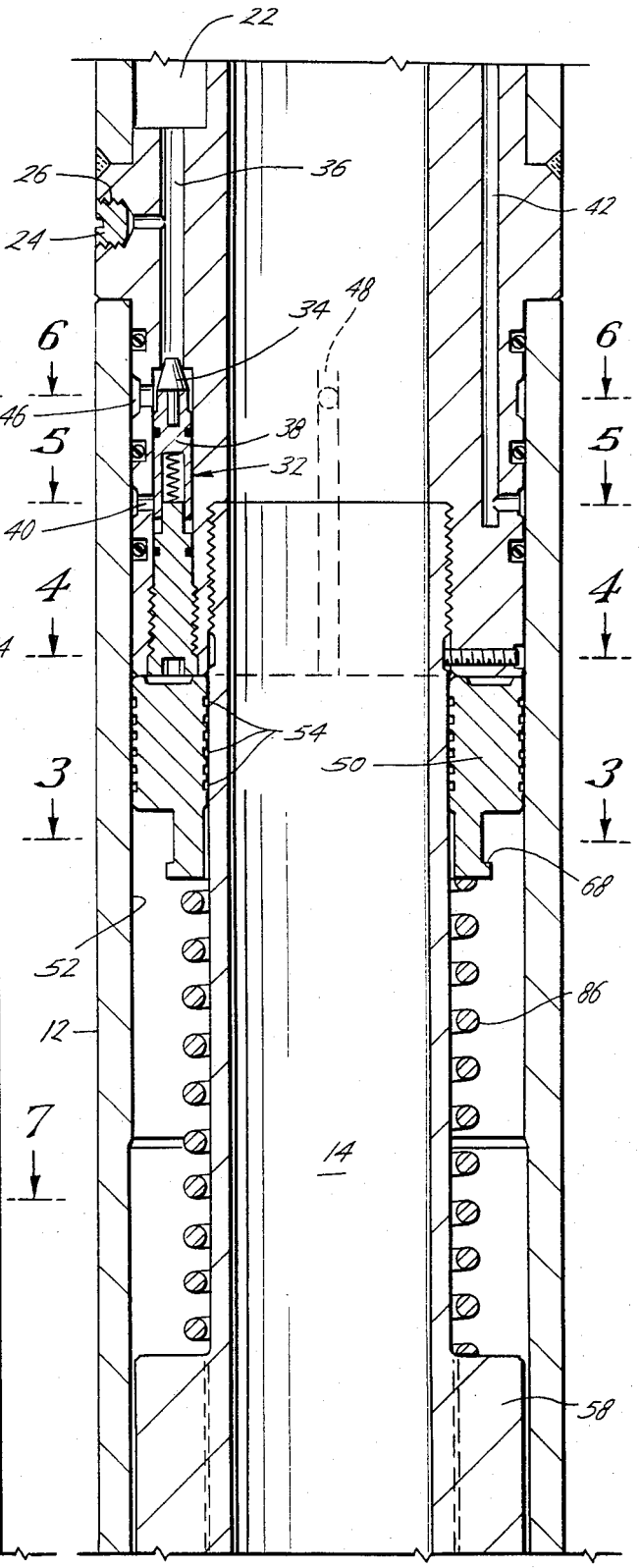
Figure 1C:
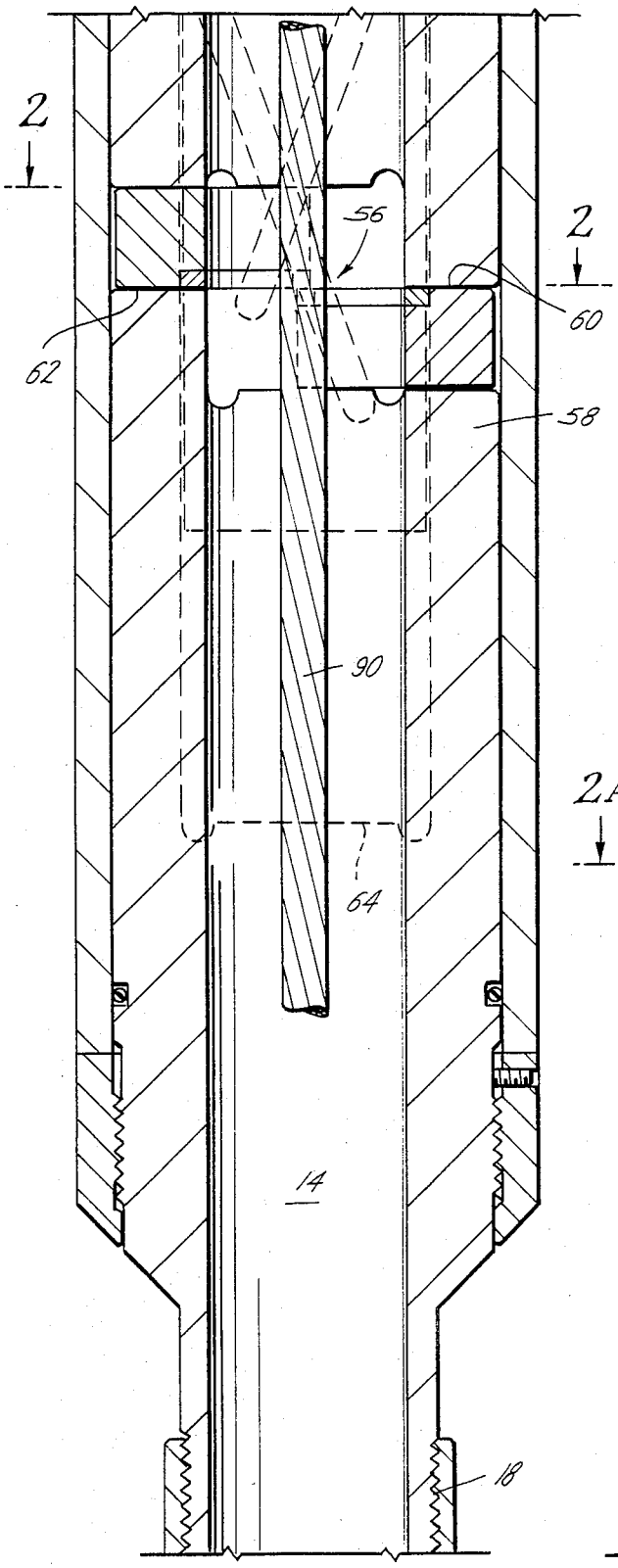

Referring now to the drawings, particularly to FIGS. 1A, 1B and 1C, the reference numeral 10 generally indicates the service line cutter of the present invention having a housing 12 and a bore 14 therein through which a service line (FIG. 1C), usually having a wireline, may extend. The housing 12 includes connections such as upper threads 16 and lower threads 18 for connection in a well conduit 20 such as a production or test string extending in an oil and/or gas well. The bore 14 is preferably as large as the internal diameter of the well conduit 20 so as not to interfere with service operations of fluid flow.

The housing 12 includes an energy chamber 22 for holding energy which is preferably a compressed gas such as nitrogen or it could be other energy producing mediums such as explosive, chemical or electrically produced energy charges. Compressed gas can be charged into the chamber 22 for a one-time operation by means of a port 24 (FIG. 1B) which is closed by plug 26 or as an alternative and as preferable, through a port 28 (FIG. 1A) which is connected to a line 30 leading to the well surface for charging and recharging the chamber 22 and also for introducing cleaning fluids therein as will be more fully discussed hereinafter.

Figure 7:
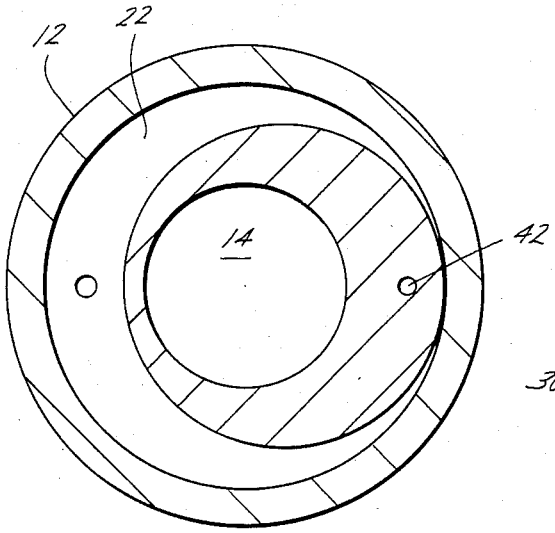
FIG. 7 is a cross-sectional view taken along the line 7—7 of FIG. 1A.
Figure 8:
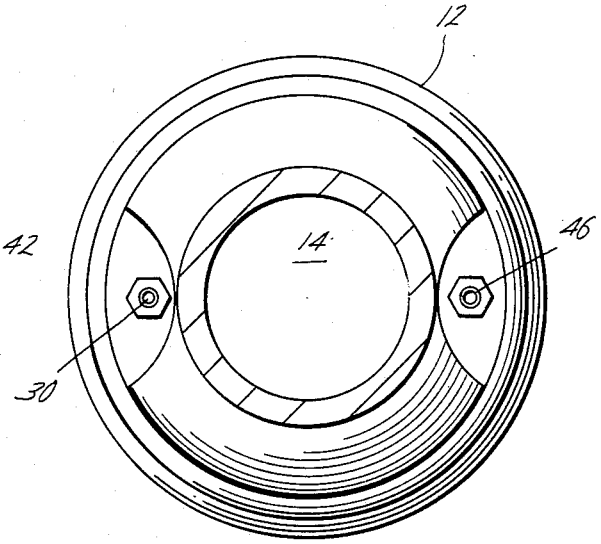
FIG. 8 is a cross-sectional view taken along the line 8—8 of FIG. 1A.
Figure 10:
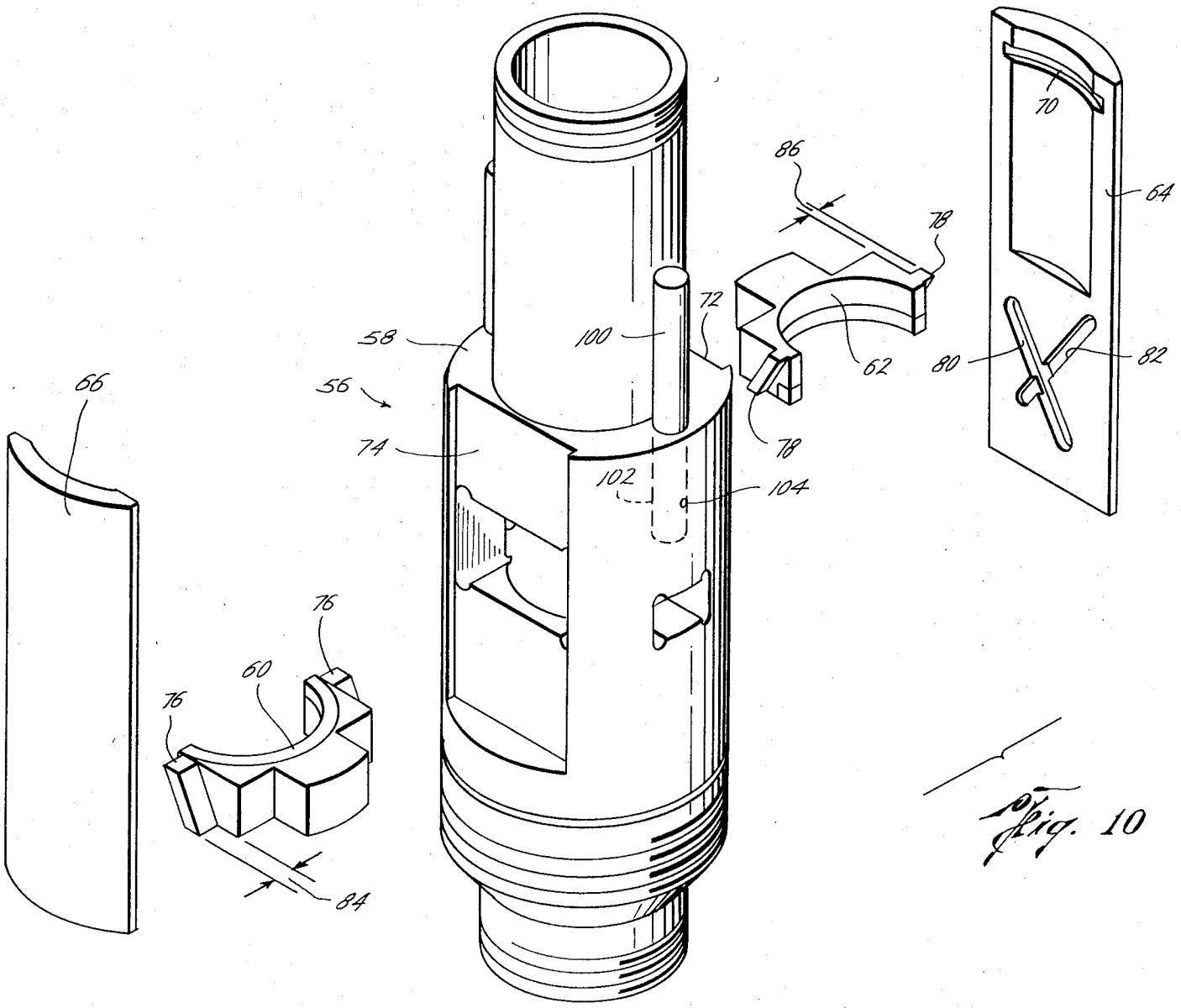
FIG. 10 is an exploded perspective view of the cutting assembly of the present invention.

Preferably, as best seen in FIG. 7, the energy chamber 22 is eccentrically shaped in order to economically manufacture the chamber 22 while providing a thick wall for containing the pressurized hydraulic port 44 and line 42 which will be described hereinafter.

Figure 5:
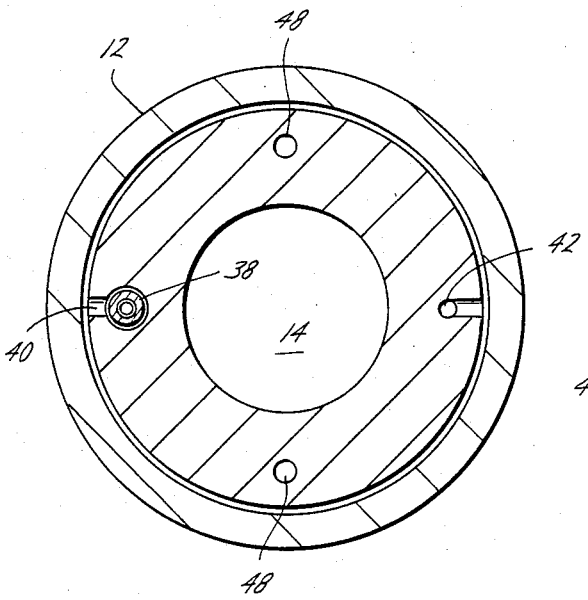
FIG. 5 is a cross-sectional view taken along the line 5—5 of FIG. 1B.
Figure 6:
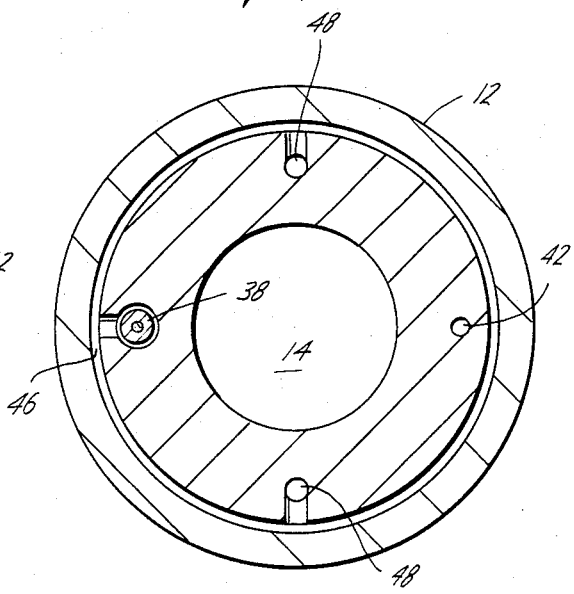
FIG. 6 is a cross-sectional view taken along the line 6—6 of FIG. 1B.

Referring now to FIGS. 1B, 5 and 6, valve means generally indicated by the reference numeral 32 are shown for releasably holding pressure in the energy chamber 22. The valve mechanism includes a valve element 34 which initially is seated closing the outlet 36 of the chamber 22 and is seated by the action of a control piston 38. The control piston 38 is in communication with a passageway such as annular passageway 40 which leads to tubular passageway 42 which in turn is connected to a port 44 (FIG. 1A) which is adapted to be connected to a hydraulic fluid supply such as a control line 46 or a casing annulus which extends to the well surface. Thus, application of hydraulic fluid pressure through the control passageways 42 and 40 acts on the piston 38 to seat the valve element 34 closing the energy chamber 22. The hydraulic force exerted on the piston 38 is sufficient to maintain the valve element 34 seated and to withstand the pressure in the pressurized gas chamber or energy chamber 22. When pressure is reduced in the hydraulic control passageways 42 and 40, the gas pressure in the gas chamber 22 will overcome the force of the piston 38 and move out of the chamber 22 into an annular passageway 46 and into a tubular passageway 48.

Figure 3:
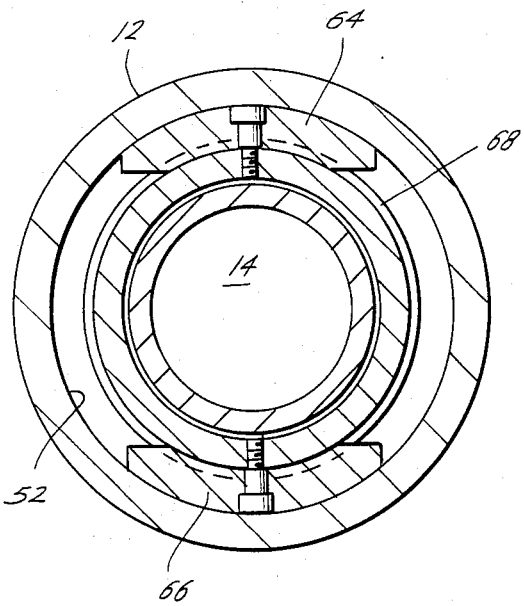
FIG. 3 is a cross-sectional view taken along the line 3—3 of FIG. 1B.
Figure 4:
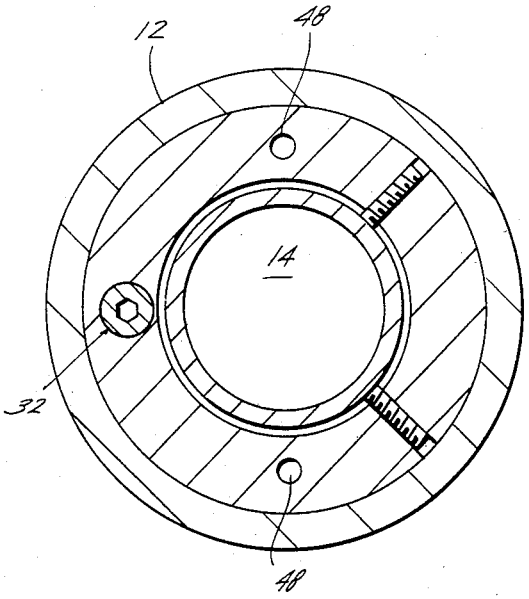
FIG. 4 is a cross-sectional view taken along the line 4—4 of FIG. 1B.

Referring now to FIGS. 1B, 3 and 4, actuating piston means 50 is telescopically movable in a cylinder 52 and the cylinder is in communication with the energy chamber 22 through the valve mechanism 32. That is when the valve 32 is opened, pressurized energy from the chamber 22 flows into the annular passageway 46 and into the tubular passageway 48 onto the top of the annular piston 50. Preferably, the piston 50 has a plurality of turbulent type seals 54 which, while restricting fluid flow between the piston 50 and the cyliner 52 sufficiently to cause movement of the piston 50, allows fluid to bypass around the piston 50 for cleaning purposes and for allowing the retraction of the piston 50 as will be more described hereinafter.

The piston 50 is connected and actuates a cutter assembly generally indicated by the reference numeral 56. (FIGS. 1B, 1C, 2 and 3). The cutter means includes a housing 58 having first 60, and second 62, semi-circular cutters normally retracted in the housing 58 and out of the bore 14 (FIG. 1C) and actuating links 64 and 66, respectively, for actuating the cutters 60 and 62, respectively. The actuating links 64 and 66 are connected to a circular shoulder 68 on the piston 50 by coacting grooves 70 and the links 64 and 66 telescopically move in windows 72 and 74, respectively, in the housing 58. Therefore, longitudinal movement of the piston 50 carries the actuating links 62 and 64 downwardly and upwardly.

The cutters 60 and 62 are actuated by cam means. Thus, cutter 60 includes first ears 76 on each side and cutter 62 includes ears 78 on each side. Each of the links 64 and 66 includes a first track 80 and a second track 82 for coacting with the ears 76 and 78, respectively. Preferably, the depth 84 of the ears 76 is greater than the depth 86 of the ears 78. Similarly, the coacting track 82 for the ears 78 has less depth for receiving the ears 78 than the depth of the track 80 which receives the ears 76. Thus, while the tracks 80 and 82 cross each other, the ears 76 are less likely to catch in the track 82 and the ears 78 are less likely to catch in the track 80 because they will follow their own respective tracks because of their coacting and different depths.

Figure 9:
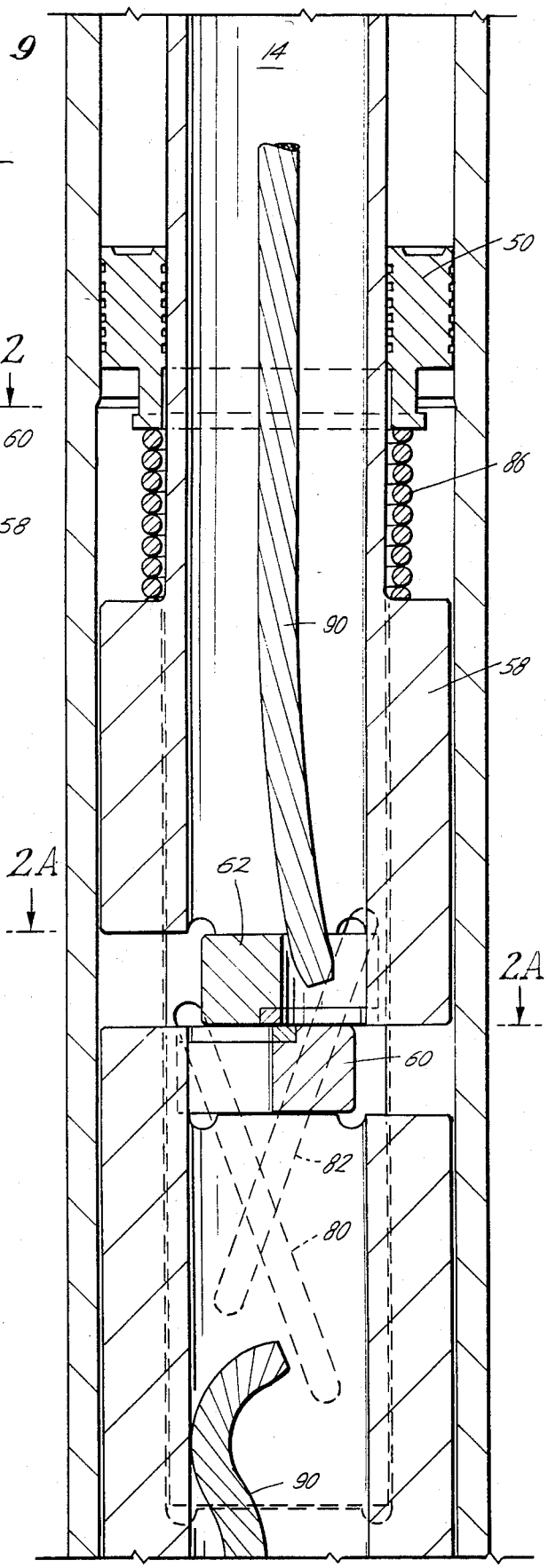
FIG. 9 is an elevational view, in cross section, of the cutter assembly of the present invention shown in position cutting a service line.
Figure 2:
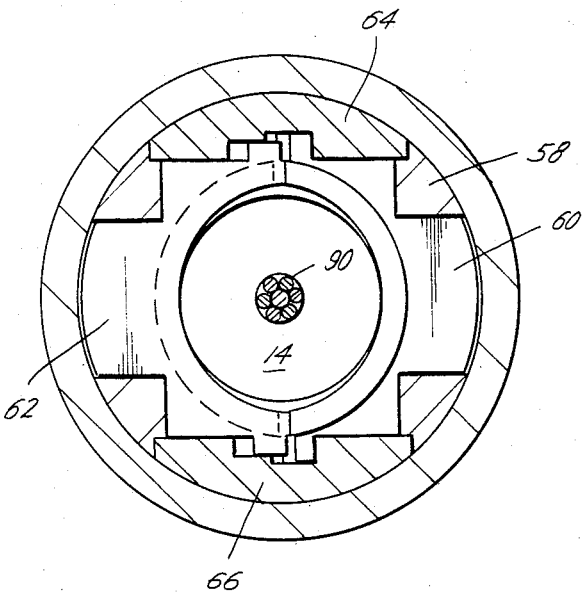
FIG. 2 is a cross-sectional view taken along the line 2—2 of FIG. 1C.
Figure 2A:
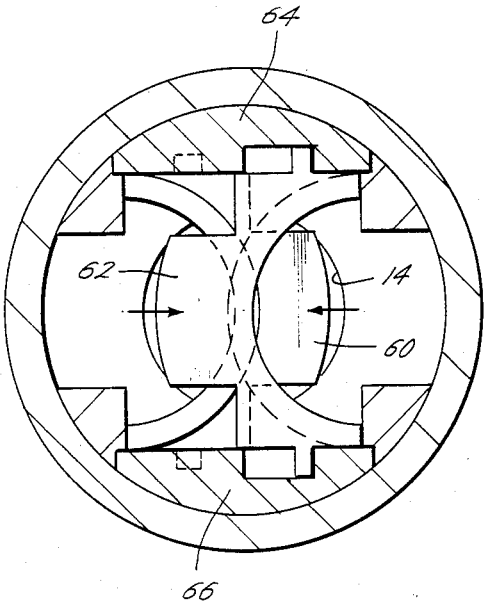
FIG. 2A is a view taken along the line 2A—2A of FIG. 9.

Downward movement of the piston 50 carries the links 64 and 66 downwardly. The downward movement of the tracks 80 and 82 coacts with the ears 76 and 78, respectively, to cause the cutters 60 and 62 to be cammed inwardly and to overlap, as best seen in FIGS. 2A and 9, for cutting a service line 90.

After the service line 90 is cut, it is desirable that the cutters 60 and 62 return to their retracted position for clearing the open bore 14 whereby the cut wireline tool string can be retrieved after the emergency has been controlled. Therefore, biasing means such as a spring 86 is provided between the piston 50 and the cutter housing 58 for biasing the piston to its initial position, carrying the links 64 and 66 upwardly whereby the tracks 80 and 82 move upwardly to coact with the ears 76 and 78, respectively, to retract the cutters 60 and 62. The spring 86 is able to bias the piston 50 upwardly after the line 90 has been cut as the gas will bypass the piston 50, pass through the cutter assembly 56 and into the bore 14.

In operation, the cutter 10 is installed in a well conduit 20. Hydraulic fluid pressure is then applied to the control passageways 40 and 42, such as through the control line 46 leading to the well surface, to act against the pilot piston 38 to close the valve element 34. The gas pressure chamber 22 may then be pressurized to provide an energy charge in the chamber 22. Of course, the force of the hydraulic fluid in te control passageways is maintained at a sufficient pressure to contain the gas pressure in the chamber 22 until it is needed. In the event of an emergency, the hydraulic fluid pressure in the control line 46, passageway 42 and annular passageway 40 is reduced thereby reducing the force holding the hydraulic pilot piston 38 against the valve element 34. On a sufficient reduction of hydraulic pressure, the gas in the chamber 22 will move the valve element 34 downwardly and the gas will flow out of the annular passageway 46, through the tubular passageway 48 and act on the piston 50 moving the piston 50 downwardly.

Downward movement of the piston 50 carries the actuating links 64 and 66 downwardly which in turn moves the cutting elements 60 and 62 inwardly to cut any line therein. It is advantageous to merely relieve the hydraulic pressure in the control line 46 as this can usually always be done in an emergency. In an emergency it is not always possible to apply increased hydraulic pressure down a well such as to actuate a double acting hydraulic piston for cutter operation as the well controls may fail. Therefore, the present cutter merely uses an already pressure charged chamber 22 to actuate the cutter for emergency purposes.

While the line 30 may be omitted by pressurizing the chamber 22 through the plug 26 while holding a hydraulic force against the control piston 38, such an operation would only provide a one time operation. Preferably, the gas control line 30 by being connected between the well surface and the energy chamber 22 allows multiple operations of the cutter 10 without retrieving the entire well conduit string 20 for replacing or recharging the cutter 10.

It is also to be noted that the piston 50 is positioned below the energy chamber 22 and that the cutter mechanism 56 is positioned below the piston 50. Since the cutters must extend into the bore 14 for cutting any service lines such as 90, the cutter mechanism 56, the piston 50 and other parts of the valve 10 are subject to corrosive and dirty well fluids. By using the line 30 extending to the surface, cleaning fluids may be inserted into the energy chamber 22, the hydraulic control fluid pressured reduced, and the cleaning fluids will pass downwardly through the valve element 34, bypass the piston 50 by virtue of its turbulent seals 54, and through the cutter mechanism 56 thereby flushing and cleaning the working parts of the cutter 10.

If desired, a shock absorber may be provided between the piston 50 and the cutting mechanism 56 to avoid the shock of the energy released from chamber 22. Thus rods 100 are movable in fluid chambers 102 which have outlet orifices 104. Downward engagement of the pistons 50 engages the rods 100 which are cushioned by the fluid in the chambers 102.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A fluid actuated energy charged well service line cutter for connection in a well conduit for cutting a line extending therethrough comprising, a housing, said housing having a bore through which the line may extend, and said housing including connections for attaching the housing in a well conduit, said housing including an energy chamber for holding energy, valve means connected to the chamber for releasing energy from the chamber, control means connected to said valve means and extending to the well surface for actuating the valve means, piston means in the housing in communication with the energy chamber through the valve means whereby the piston is actuated when the valve means releases energy from the chamber, cutter means in the housing normally retracted out of said bore, said cutter means connected to and moved by the piston into the bore for cutting any line in said bore, and means for returning the piston and cutter means to a retracted position.

2. The apparatus of claim 1 wherein the energy chamber is a pressurized gas chamber.

3. The apparatus of claim 2 wherein the gas chamber is an eccentrically shaped chamber for increasing the wall thickness for containing a portion of the control means.

4. The apparatus of claim 2 wherein the gas chamber includes a supply line extending to the well surface for recharging the chamber.

5. The apparatus of claim 1 wherein the returning means is a biasing means.

6. The apparatus of claim 5 wherein the biasing means is spring acting against the piston.

7. The apparatus of claim 1 wherein the valve means includes, a valve initially closing the chamber, a control piston acting against the valve for holding the valve closed, and said control means includes hydraulic fluid initially acting against the control piston initially holding the valve closed, but allowing the valve to open upon a decrease in the hydraulic fluid pressure.

8. The apparatus of claim 1 wherein the piston means includes a seal which restricts but allows the passage of fluid whereby cleaning fluid may be inserted into the chamber for bypassing the piston and cleaning.

9. The apparatus of claim 1 wherein the cutter means includes, first and second coacting cutters, and cam means between the first and second cutters and the piston means for moving the cutters inwardly and outwardly in response to movement of the piston means.

10. The apparatus of claim 9 wherein the cam means includes:

a first ear on the first cutter, a second ear on the second cutter, first and second tracks connected to the piston for receiving the first and second ears, respectively, said first ear and first track being of a different depth than the depth of the second ear and second track for reducing the possibility of the ears catching in the wrong track.

11. A fluid actuated energy charged well service line cutter for connection in a well conduit for cutting a line extending therethrough comprising, a housing, said housing having a bore through which the service line may extend, said housing including threaded connections at each end for connecting the housing in a well conduit, said housing including an energy chamber for holding pressurized gas, valve means connected to the chamber for releasably holding pressurized gas in the chamber and exposed to pressurized gas in the chamber which acts against the valve means in a direction to open the valve means, said valve means includes a control piston, a control passageway exposed to the control piston and adapted to extend to the well surface for receiving hydraulic fluid acting in a direction to close the valve means, but which allows the valve means to open on a reduction in pressure in the control passageway, actuating piston means in the housing in communication with the energy chamber through the valve means whereby the actuating piston is actuated when the valve means is opened, cutter means in the housing normally retracted out of the said bore, said cutter means connected to and moved by the actuating piston into the bore for cutting any line in the bore, and biasing means connected to the actuating piston for returning the piston and cutter means to a retracted position.

12. The apparatus of claim 11 wherein the gas chamber is eccentrically shaped for increasing the size of the chamber.

13. The apparatus of claim 11 wherein the biasing means is spring acting between the housing and the acutating piston.

14. The apparatus of claim 11 wherein the gas chamber includes a supply line extending to the well surface for recharging the chamber.

15. The apparatus of claim 11 wherein the actuating piston means is positioned below the gas chamber, and the actuating piston includes a seal which restricts but allows the passage of fluid, and the cutter means is positioned below the actuating piston and the chamber includes a line extending to the well surface whereby cleaning fluid may be inserted into the chamber for bypassing the piston and cleaning the apparatus.

16. The apparatus of claim 11 wherein the cutter means includes, first and second coacting cutters, and cam means between the first and second cutters and the actuating piston means for moving the cutters inwardly and outwardly in response to movement of the actuating piston.

17. The apparatus of claim 16 wherein the cam means includes, first ears on the first cutter, second ears on the second cutter, first and second tracks connected to the piston for receiving the first and second ears, respectively, said first and second tracks crossing each other, and said first ears and first tracks being of a different depth than the depth of the second ears and second tracks for reducing the possibility of the ears catching in the wrong track.

18. The apparatus of claim 11 including, a shock absorber positioned in the housing and contacted by the actuating piston for reducing the shock of the released gas.

* * * * *